United States Patent [19]

Gubitose et al.

[11] 4,068,788

[45] Jan. 17, 1978

[54] METHOD FOR CRACKING BRITTLE MATERIAL

[75] Inventors: Nicholas Francis Gubitose, Moosic; Leonard Gawelko, Wilkes Barre, both of Pa.; Robert Joseph Satriano, Allamuchy, N.Y.

[73] Assignee: RCA Corporation, New York, N.Y.

[21] Appl. No.: 617,632

[22] Filed: Sept. 29, 1975

[51] Int. Cl.[2] ..... B26F 3/00

[52] U.S. Cl. ..... 225/1; 225/2; 225/96.5; 225/103

[58] Field of Search ..... 225/2, 93, 94, 96.5, 225/103, 104, 1; 29/413; 83/35, 36

[56] References Cited

U.S. PATENT DOCUMENTS

| | | | |
|---|---|---|---|
| 2,659,950 | 11/1953 | West | 225/93 X |
| 3,149,765 | 9/1964 | Horning et al. | 225/103 X |
| 3,565,306 | 2/1971 | St. Louis | 225/96.5 X |
| 3,602,410 | 8/1971 | Dennis et al. | 225/103 X |
| 3,790,051 | 2/1974 | Moore | 225/103 X |
| 3,870,196 | 3/1975 | Hargraves | 225/103 X |

*Primary Examiner*—Frank T. Yost
*Attorney, Agent, or Firm*—H. Christoffersen; R. P. Williams; R. A. Hays

[57] ABSTRACT

A machine for separating a sheet of brittle material, for example a semiconductor wafer, into a plurality of pellets is disclosed. The pellets are defined by a plurality of intersecting scribed lines on the sheet. The machine includes a member for applying a shear force to an edge of the sheet whereby the maximum bending moment is applied at a preselected scribe line. The machine is particularly applicable for use with those semiconductor wafers which have a solder coating on both sides.

4 Claims, 4 Drawing Figures

METHOD FOR CRACKING BRITTLE MATERIAL

This invention relates to the cracking of a sheet of brittle material in general, and in particular to the cracking of semiconductor wafers which have a coating of solder on the major surfaces thereof.

Present semiconductor technology includes the manufacture of a plurality of individual circuit devices on a single semiconductor wafer. The individual "pellets", as they are called in the art, must be separated from the wafer for further processing. To this end, a plurality of intersecting scribe lines is made on the wafer along the boundaries of the individual pellets. It then remains to separate the pellets from the semiconductor wafer into individual units. One of the most common methods used to accomplish this separation is to place the scribed wafer on a cylindrical surface and roll a second cylindrical surface across the wafer, thereby forcing it into the first cylindrical surface and causing the wafer to crack along the scribed lines. This technique is discussed in detail in U.S. Pat. No. 3,786,973.

Another method of separating a semiconductor wafer into individual pellets comprises placing the scribed wafer on a stage with the scribe lines facing the stage and applying a force on the unscribed side of the wafer directly opposite each scribe line. The stage has slots over which the scribe lines are located. The application of the force from the opposite side of the scribe line causes the wafer to break along the scribe lines. This method is discussed in more detail in U.S. Pat. No. 3,565,306.

Although these cracking methods are generally sufficient to accomplish the desired separation, they are quite inadequate if the wafer is coated with solder, for example. In this case neither of the above-described prior art methods completely separates the pellets from the wafer. After the force is applied there is often a layer of solder remaining which acts as a hinge when the break takes place. As such the pellet is not completely separated from the wafer and separation must be completed by a further operation.

Figure 1:
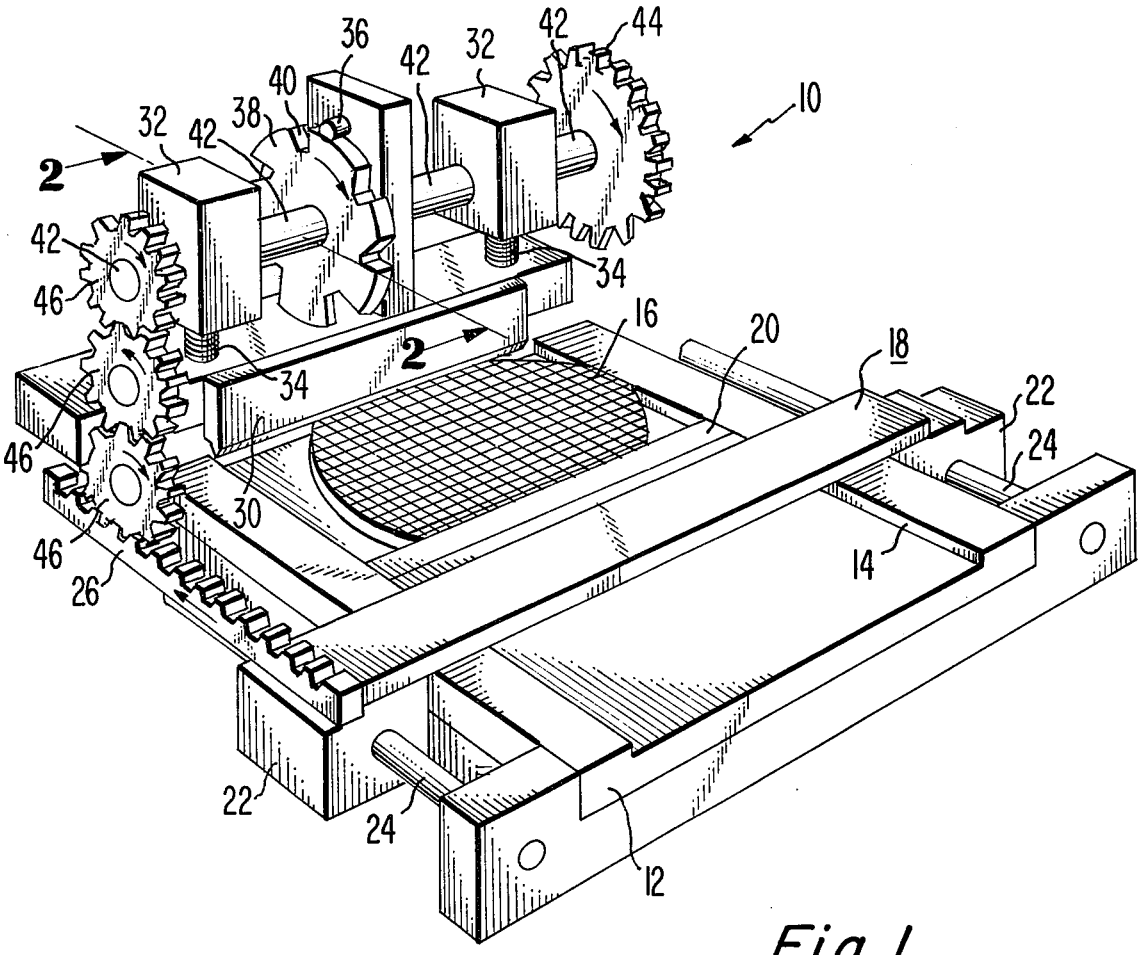
FIG. 1 is a perspective view of the present brittle material cracking machine, not drawn to scale.

In preparation for cracking a sheet of brittle material, for example a semiconductor wafer, the sheet is initially scribed into rows and columns to weaken the sheet where the separation is to take place. The scribing may be performed by any method known in the art. The scribe lines are usually made in two sets, generally perpendicular with each other, to outline the plurality of individual pellets. The individual pellets, in this example, contain previously fabricated semiconductor devices.

The basic concept of the present invention is to utilize a pellet or row of pellets in a manner similar to an ordinary cantilever beam. That is, in this example, the wafer is supported at a point beyond a preselected scribed line of the wafer such that at least one row of pellets overhangs a base. A shear force is applied to the overhanging row of pellets. The shear force provides a bending moment along the scribe line nearest the base. Means are provided to prevent the wafer from rotating in the direction of the bending moment. The shear force is applied at the edge of the pellet so that the bending moment is maximized at the scribe line. The shear force thus applied also insures that the device on the pellet is not damaged. The term "edge" as used throughout this specification is intended to include an overlap portion of the wafer surface and is not intended to be limited to the mathematical plane of the side of the wafer. This overlap portion is considered to be a distance from the mathematical plane of the side such that the device fabricated on the pellet is not contacted by the means for applying the shear force. The overlap portion may be, for example, a distance of about 20 mils (about 500 micrometers) from the mathematical plane of the side of the wafer. The wafer, upon encountering such a bending moment, fractures at the preselected scribe line, and the pellet or row of pellets separate from the wafer. The shear force is most effectively applied in a direction such that the bending moment rotates the overhanging pellet row in a direction which opens the scribe line. That is, the scribe lines in the wafer are oriented toward the means for applying the shear force. As a result, the more defined force at the scribe line completely separates a pellet or row of pellets from the adjacent row. The operation is repeated on the next pellet or next row of pellets of the wafer. Upon completion of the repeated operations on all the scribe lines in one direction, the wafer is rotated 90° and the sequence of operation is repeated until all of the pellets are individually separated. It is generally desirable to maintain the original individual pellet location and orientation during the cracking operation. To facilitate this the wafer is placed on a flexible adhesive material prior to cracking. Hence, the separated rows of pellets maintain their original location and orientation with the rest of the pellets.

A machine, indicated generally at 10 in the drawings, designed to carry out the above-described method of cracking brittle material comprises a base 12 having means 14 for receiving and aligning a sheet of brittle material 16, for example a semiconductor wafer. The receiving and aligning means 14, in this case, is a recessed slot.

A sheet slide assembly 18 is slidably mounted on the base 12 and comprises a contact bar 20 mounted on a pair of slide blocks 22. The assembly 18 is supported by a pair of parallel rods 24 which pass through the slide blocks 22 and are rigidly attached to the base 12. A gear rack 26 is mounted on one of the slide blocks 22. The assembly 18 provides means for moving the wafer 16 along the recessed slot 14 in the base 12.

A stationary support 28, not shown in FIG. 1, is rigidly mounted on the base 12 and provides means to prevent the wafer 16 from rotating in the direction of any bending moment applied thereto. The stationary support 28 is mounted in such a manner that the linear travel of the wafer 16 is unimpeded thereby.

A shear blade 30 is mounted to a pair of guide blocks 32 which may be rigidly attached to the base 12 by methods known in the machining art, but not shown in the drawings. However, the pair of guide blocks 32 should be mounted to the base 12 in such a manner that the relative distance between the base 12 and the shear blade 30 may be varied. Preferably the shear blade 30 is mounted to the guide blocks 32 by a pair of springs 34. The size and strength of the springs 34 are chosen so that a preselected force is applied to the shear blade 30 when the springs 34 expand.

A guide 36 is attached to the shear blade 30 and contacts a cam 38 having notches 40 along the periphery thereof. The cam 38 is affixed to a rotatable rod 42 and rotates therewith. The rod 42 is supported by and extends through the guide blocks 32. The rotation of the rod 42, and hence the cam 38 is controlled by a control knob 44.

The movements of the cam 38 and assembly 18 are synchronized by a plurality of gears 46 between the rod 42 and the gear rack 26.

The machine 10 is utilized to crack semiconductor wafers as follows. A previously scribed wafer 16 is placed in the recessed slot 14 of the base 12 and aligned so that one set of scribe lines is parallel with the shear blade 30. The alignment step may be accomplished by placing a first flat edge of the wafer 16, which is parallel to one set of scribe lines, flush against the contact bar 20 of the assembly 18. Preferably, a second flat edge, perpendicular to the first flat edge, is placed against the recessed slot 14 of the base 12.

Figure 2:
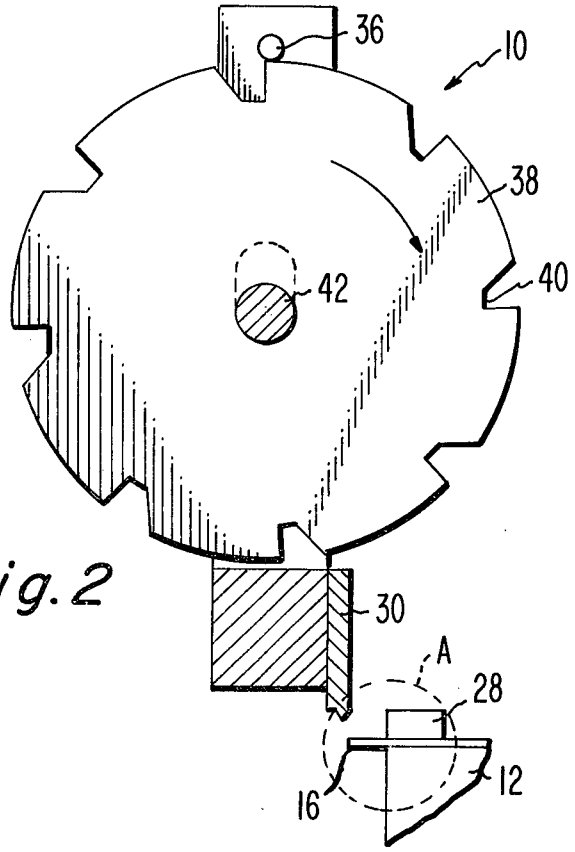

The control knob 44 is rotated in the direction indicated by the arrow shown in FIG. 1. In response, the rod 42, the cam 38, the shear blade 30 and the assembly 18 are moved to a position such as that shown in FIG. 2. As shown therein, the wafer 16 extends beyond the base 12 under the stationary support 28. The guide 36 is on the periphery of the cam 38. The shear blade 30 is raised and the springs 34 are compressed.

Figure 4:
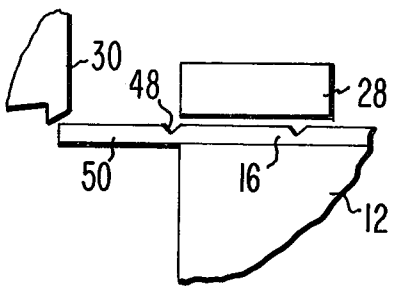
FIG. 4 is an exploded view of the portion A of FIG. 2, not drawn to scale.

An exploded view of the position of the wafer 16 with respect to the stationary support 28 and the shear blade 30 is shown in FIG. 4. It is seen therein that the wafer 16 overhangs the base 12 so that one scribe line 48 is beyond the base 12.

Figure 3:
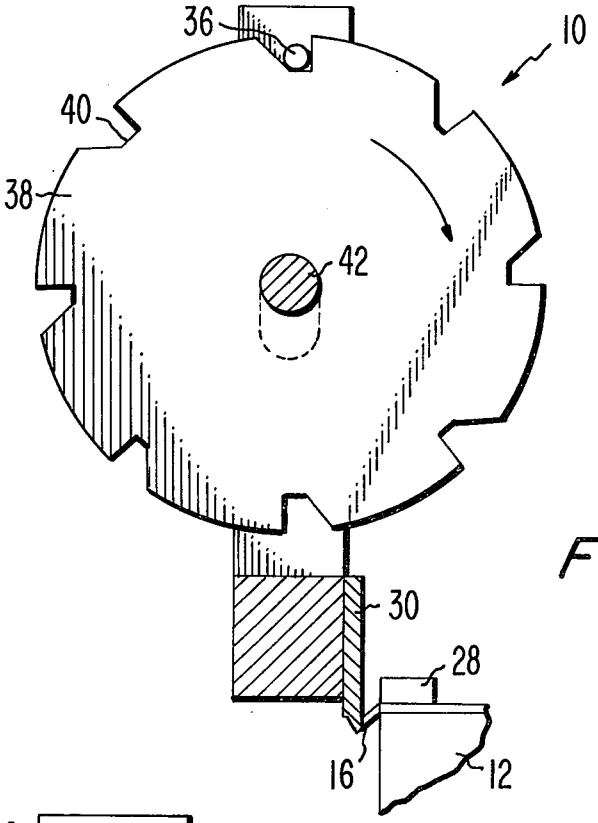
FIGS. 2 and 3 are partial cross-sectional views of the present machine taken along the line 2—2 of FIG. 1 at different positions of operation, not drawn to scale.

As the control knob 44 is rotated further the guide 36 reaches and drops into a notch 40 on the cam 38. This position is shown in FIG. 3 of the drawings. Since the guide 36 is no longer supported by the periphery of the cam 38 the springs 34 expanded, moving the shear blade 30 toward the wafer 16. The shear blade 30 contacts the wafer 16 at the overhanging edge thereof and applies a shear force thereto.

The shear force thus applied is transferred into a bending moment at the scribe line 48 whereupon the wafer 16 fractures at the scribe line 48 and the overhanging portion 50 is thereby separated from the remainder of the wafer 16. Further rotation of the control knob 44 forces the guide 36 out of the notch 40, thereby raising the shear blade 30 and compressing the springs 34. Simultaneously the wafer 16 is advanced so that a next row of pellets overhangs the base 12 prior to the guide 36 reaching the next notch 40. The gears 46 are selected so that the following row of pellets on the wafer 16 is advanced to an overhanging position prior to the guide 36 reaching the next notch 40. The frequency at which the shear blade 30 is raised and dropped is directly dependent upon the spacing of the notches 40 on the periphery of the cam 38. By the proper choice of cam 38 and gears 46 the machine 10 may be utilized to crack wafers having different sized pellets. It will be understood that the distance of the shear blade 30 relative to the base 12 is also adjusted to contact the edge of the different sized pellets.

What is claimed is:

1. A method of cracking a sheet of brittle material having two intersecting sets of parallel scribe lines, said sets enclosing a plurality of pellets thereon comprising the steps of:

supporting said sheet in a cantilever manner at a point at least one scribe line away from an edge thereof, said edge being substantially parallel with said scribe lines;

applying, by means of a shear blade, a shear force to said edge of said sheet, whereby said sheet is fractured at said one scribe line;

repeating said method until all scribe lines of one set are fractured, whereby a plurality of rows of pellets are formed; and rotating said rows of pellets and repeating said method on the other set of parallel scribe lines.

2. A method as claimed in claim 1 comprising the further step of:

synchronously raising a shear blade and advancing said edge into a cantilever position.

3. A method as claimed in claim 1 comprising the further step of:

applying said shear force in a direction such that said edge is rotated away from said one scribe line.

4. A method as claimed in claim 1 comprising the further steps of:

providing means for maintaining the original positions of each said pellet with each of the other said pellets.

* * * * *